US011498236B2

(12) United States Patent
Oesterle

(10) Patent No.: US 11,498,236 B2
(45) Date of Patent: Nov. 15, 2022

(54) SLICING MACHINE WITH MOTOR TOWER AND DIRECTLY DRIVEN CIRCULAR BLADE

(71) Applicant: Bizerba SE & Co. KG, Balingen (DE)

(72) Inventor: Markus Oesterle, Balingen (DE)

(73) Assignee: Bizerba SE & Co. KG, Balingen (DE)

( * ) Notice: Subject to any disclaimer, the term of this patent is extended or adjusted under 35 U.S.C. 154(b) by 11 days.

(21) Appl. No.: 16/920,442

(22) Filed: Jul. 3, 2020

(65) Prior Publication Data

US 2021/0008748 A1 Jan. 14, 2021

(30) Foreign Application Priority Data

Jul. 12, 2019 (EP) ..... 19186089

(51) Int. Cl.
*B26D 7/06* (2006.01)
*B26D 1/14* (2006.01)

(52) U.S. Cl.
CPC ..... *B26D 7/0616* (2013.01); *B26D 1/14* (2013.01); *B26D 2210/02* (2013.01)

(58) Field of Classification Search
CPC .... B26D 7/0616; B26D 1/14; B26D 2210/02; B26D 1/143; B26D 7/2621; B26D 5/086; H02K 5/00; H02K 15/14; H02K 5/15; H01H 2223/024; H01R 13/512
See application file for complete search history.

(56) References Cited

U.S. PATENT DOCUMENTS 2,401,662 A * 6/1946 Divi ..... H02K 5/15 310/216.127
3,083,310 A * 3/1963 Tweedy ..... H02K 1/17 324/151 R
3,437,853 A * 4/1969 Arnold ..... H02K 5/15 310/43
4,017,964 A * 4/1977 Schulte ..... H02K 5/04 310/90
4,118,644 A * 10/1978 Schulte ..... H02K 5/04 310/91
4,128,935 A * 12/1978 Czech ..... H02K 15/16 310/43

(Continued)

FOREIGN PATENT DOCUMENTS

EP 0764073 B1 8/1998
WO WO 2007130292 A1 11/2007

*Primary Examiner* — Jonathan G Riley
(74) *Attorney, Agent, or Firm* — Leydig, Voit & Mayer, Ltd.

(57) ABSTRACT

A slicing machine cuts slices of cutting material. The slicing machine has: a machine housing holding a motor and circular blade driven by the motor; a product feed, which feeds the cutting material to the circular blade; a stop plate; and a slidably arranged carriage, which feeds the cutting material to the blade. The blade is mounted directly on a bearing shaft arranged in the drive motor for the circular blade. The drive motor includes at a stator and rotor, which is detachable from the stator. The stator is in the machine housing. The machine housing has an insertion opening where, in the assembled state, the stator is arranged and through which the rotor is at least partially inserted into the stator. The slicing machine has an attachment device comprising at least one fastener that is configured to fasten the rotor and the stator to the machine housing.

16 Claims, 10 Drawing Sheets

(56) References Cited

U.S. PATENT DOCUMENTS

| | | | | |
|---|---|---|---|---|
| 4,212,098 | A * | 7/1980 | Sand | F16C 35/077 29/271 |
| 5,798,592 | A * | 8/1998 | Peterson | H02K 21/145 310/162 |
| 6,624,543 | B1 * | 9/2003 | Bankstahl | F02B 63/04 310/89 |
| 2005/0184608 | A1 * | 8/2005 | Williams | H02K 5/148 310/89 |
| 2007/0028742 | A1 * | 2/2007 | Mueller | B26D 5/02 83/676 |
| 2009/0193946 | A1 * | 8/2009 | Bondarowicz | B26D 1/143 83/13 |
| 2012/0119627 | A1 * | 5/2012 | Lau | H02K 5/15 310/90 |

* cited by examiner

SLICING MACHINE WITH MOTOR TOWER AND DIRECTLY DRIVEN CIRCULAR BLADE

CROSS-REFERENCE TO PRIOR APPLICATIONS

Priority is claimed to European Patent Application No. EP 19 186 089.9, filed on Jul. 12, 2019, the entire disclosure of which is hereby incorporated by reference herein.

FIELD

The invention relates to a slicing machine for cutting slices of, in particular, extrudate-shaped cutting material, preferably foodstuffs.

BACKGROUND

EP 076 40 73 B1 discloses such a foodstuffs cutting machine with a machine housing and a circular blade. The circular blade is mounted on a bearing shaft, which is driven by a drive motor with a stator and a rotor. The bearing shaft is mounted exclusively in the region of the drive motor.

A cutting machine, which has a motor, a bearing shaft and a blade, which is arranged directly at one end of the bearing shaft, is discussed in WO 2007/130292A1. A controller adjusts the actual rotational speed of the blade to the desired rotational speed.

In state of the art cutting machines, the drive motor for the circular blade can only be positioned and aligned in the machine housing of the cutting machine by expending a great deal of time. It is difficult to seal the region of a motor tower of the cutting machine against dirt and liquid where the motor shaft projects through the housing toward the blade axis.

SUMMARY

In an embodiment, the present invention provides a slicing machine for cutting slices of extrudate-shaped cutting material. The slicing machine has: a machine housing, which holds a drive motor and a rotating or circumferentially movable circular blade, which is driven by the drive motor; a product feed, which is configured to feed the cutting material to the circular blade; a stop plate; and a slidably arranged carriage, which is configured to feed the cutting material to the circular blade. The circular blade is mounted directly on a bearing shaft arranged in the drive motor for the circular blade. The drive motor comprises at least one stator and one rotor. The rotor is configured to be detachable from the stator. The stator is arranged in the machine housing. The machine housing has an insertion opening where, in the assembled state, the stator is arranged and through which the rotor is at least partially inserted into the stator. The slicing machine has an attachment device comprising at least one fastener that is configured to fasten the rotor and the stator to the machine housing.

BRIEF DESCRIPTION OF THE DRAWINGS

Embodiments of the present invention will be described in even greater detail below based on the exemplary figures. The present invention is not limited to the exemplary embodiments. All features described and/or illustrated herein can be used alone or combined in different combinations in embodiments of the present invention. The features and advantages of various embodiments of the present invention will become apparent by reading the following detailed description with reference to the attached drawings which illustrate the following.

DETAILED DESCRIPTION

Figure 1:
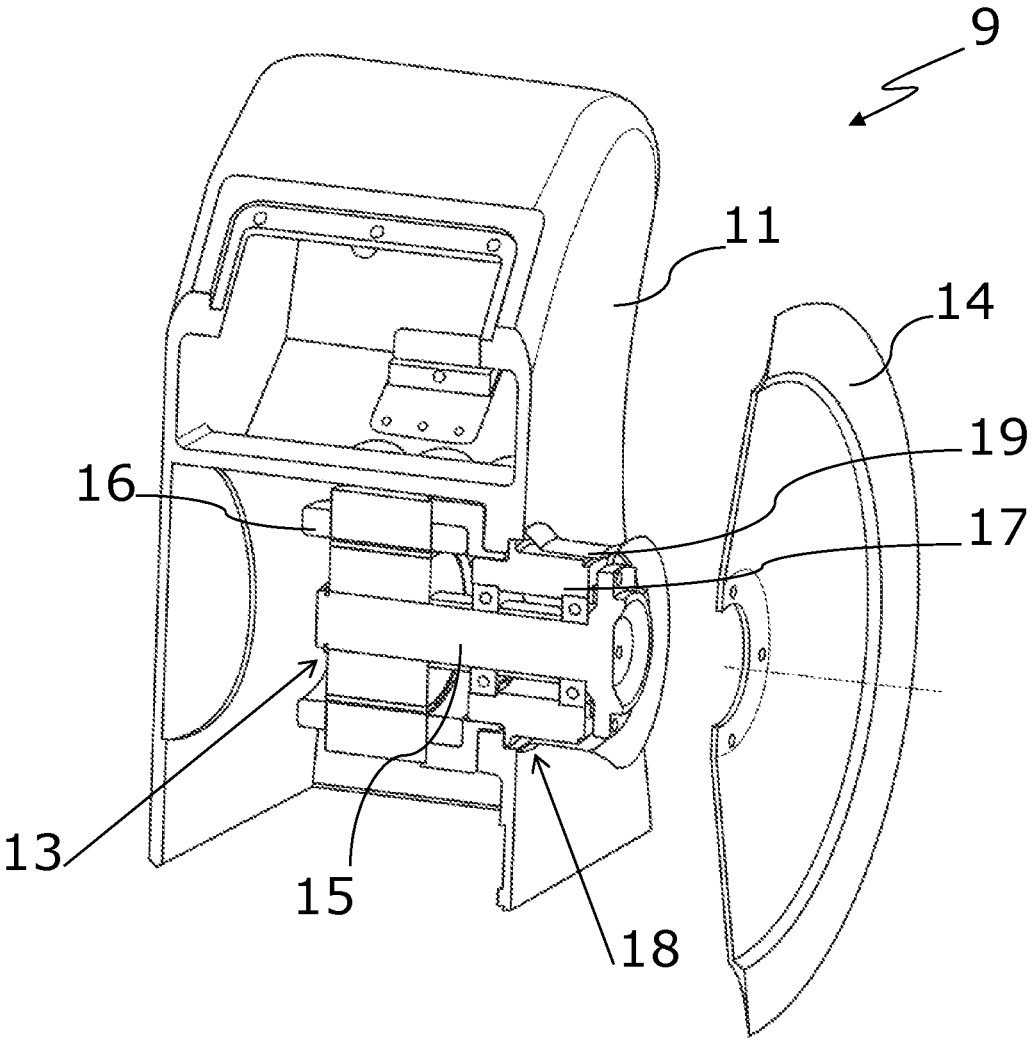
FIG. 1 a longitudinal section through a motor tower and a circular blade of a slicing machine according to the invention.

Embodiments of the present invention relate to a slicing machine for cutting slices of, in particular, extrudate-shaped cutting material, preferably foodstuffs, with a machine housing, which holds a drive motor and a rotating and/or circumferentially movable circular blade driven by the drive motor, and with a product feed, which supplies the cutting material to the circular blade. The slicing machine has a stop plate and a slidably arranged carriage, via which the cutting material is fed to the circular blade. The circular blade is mounted directly on a bearing shaft arranged in the drive motor for the circular blade. The drive motor includes at least one stator and one rotor.

Embodiments of the present invention provide an improved slicing machine along with an improved method for manufacturing the slicing machine such that the drive motor can be mounted and aligned at the machine housing comparatively simply and with little expenditure of time.

Certain improvements are achieved with regard to the device in a technically particularly simple and surprisingly effective manner by providing a slicing machine, which is characterized by the rotor being formed to be detachable from the stator. Thereby, the stator is arranged in the machine housing. The machine housing has an insertion opening where, in the assembled state, the stator is arranged and through which the rotor is at least partially inserted into the stator. The slicing machine has an attachment device for fastening the rotor and stator to the machine housing by means of fastening means.

The stator can be fastened inside the machine housing. The rotor can then be introduced from outside through the insertion opening into the machine housing and the stator. The motor is not mounted as an entire unit. The stator and rotor are mounted separately. This avoids a cumbersome introduction of the entire motor into the machine housing and an alignment of the rotor out of the machine housing, which involves a high expenditure of time. In particular, the stator is fastened from the inside in a motor tower of the slicing machine and the rotor is fastened from outside to the motor tower. The motor tower can be given a comparatively narrow design. The simplified installation of the motor is effected by the additional step, not known from the state of the art, of introducing the rotor into the stator after the arrangement of the stator (without the rotor and the bearing shaft) in the machine housing. In contrast, in the state of the art, the entire motor is always fastened on the inside and the motor shaft projects through the housing. The motor must be displaced from bottom to top inside the motor tower and the bearing shaft then guided through an opening in the machine housing. This is only possible when the motor tower has a very wide or non-integral design.

In a first embodiment of the present invention, the attachment device includes first through-openings for introducing the fastening means, which are arranged around the insertion opening. The through-openings are arranged in particular symmetrically around the insertion opening. Fastening means (fasteners), such as screws or bolts, can be introduced through the first through-openings.

In a development of this embodiment, the stator has fastening-means receptacles in the circumferential direction for receiving the fastening means. In particular, the fastening means can be fastened in the fastening-means receptacles.

In advantageous embodiments, the rotor has second through-openings in the circumferential direction for introducing the fastening means. In this embodiment, the fastening means are in particular guided through the second through-openings in order to fasten the rotor to the machine housing.

A preferred embodiment of the slicing machine is characterized in that the fastening-means receptacles of the stator and the second through-openings of the rotor can be positioned, at the first through-openings of the attachment device, with positive locking for the introduction of the fastening means. In this embodiment, the fastening means are in particular guided through the second through-openings of the rotor and through the first through-openings around the insertion opening and introduced into the fastening receptacles of the stator in which they are fastened, for example by being screwed into internal threads of the fastening receptacles. The rotor is then fastened to the motor housing and the stator. The stator is not screwed from the inside to the housing. The stator is moved from the inside only to the correct location, then the rotor is introduced into the stator from outside, and the fastening means, in particular bolts which bolt the rotor to the machine housing, also bolt the stator from the inside. The fastening receptacles of the stator act like nuts for these bolts.

A preferred embodiment of the slicing machine according to the present invention is characterized in that the bearing shaft is arranged in the rotor partially or entirely outside the machine housing. This makes a comparatively simple replacement of the bearing shaft possible.

In a further embodiment of the slicing machine, the insertion opening of the machine housing has a stepped recess or chamfer for the centering insertion of the rotor. Due to the chamfer, the stator and the rotor align themselves suitably when being fastened to the machine housing.

In another preferred embodiment, the slicing machine can be characterized by a holder for holding the stator and/or the rotor being arranged on the inner wall of the machine housing. In particular, the holder causes the stator and the rotor to align themselves automatically when being fastened to the machine housing, so that all components fit into one another during assembly. The stator is supported by the holder in a stable manner.

An advantageous embodiment is characterized by a protective cap being arranged on the rotor in the circumferential direction and in a manner abutting the machine housing and the circular blade. The protective cap is used to shield the rotor, in particular from dirt from the environment.

A further preferred embodiment is characterized by the rotor having a fastening part, which can be fastened to the machine housing and/or to the stator, in which the bearing shaft with the circular blade is mounted rotatably and is preferably fluid-sealed relative to the interior of the machine housing. The rotor can be fastened to the machine housing and/or the stator from outside by means of the fastening part.

According to a further advantageous embodiment, the slicing machine can be characterized in that the rotor has an abutment section, which on the one hand is firmly seated on the bearing shaft and is connected by a connecting section to ball bearings, which separate a holding section connected to the stator from the rotatable bearing shaft, wherein the connecting section has a narrower diameter than the abutment section and the holding section. By means of sections with different diameters, among other things the weight of the rotor can be reduced.

In a further preferred embodiment, the stator has an insertion ring for insertion into the insertion opening of the machine housing. When using such an insertion ring, the insertion opening can be formed with a smaller diameter than the outer diameter of the stator.

A further embodiment is characterized by the insertion opening having a circular or square cross-section.

A preferred embodiment of the slicing machine is characterized by an integrally formed motor tower. The drive motor can be installed comparatively easily within an integrally formed motor tower. For this purpose, the stator is introduced into the motor tower and is positioned at the insertion opening. The rotor is introduced into the stator through the insertion opening and fastened to the motor tower and the stator. After assembly, the stator is fastened on the inside of the motor tower and the rotor is fastened to the motor tower from outside.

A method for manufacturing slicing machines according to an embodiment of the present invention is also provided. This method can include the following steps:

(a) providing the two-part drive motor with the stator and the rotor detachable from the stator along with the machine housing with the insertion opening and the attachment device;
(b) pre-assembling the stator inside the machine housing at the insertion opening;
(c) introducing the rotor from outside the machine housing through the insertion opening into the stator;
(d) fastening the rotor and the stator to the machine housing by means of the attachment device; and
(e) fastening the circular blade to the rotor outside the machine housing.

In such a method, the drive motor can be mounted in the machine housing in a particularly simple manner. The stator can be introduced comparatively easily into the machine housing and positioned at the insertion opening. The rotor can then be arranged through the insertion opening partly on the outside of the machine housing and partly in the rotor. A positioning and aligning of the drive motor with the drive shaft in the machine housing, which is associated with a high expenditure of time, is therefore avoided.

Other features and advantages of the present invention will become apparent from the following detailed description of embodiments of the invention with reference to the figures in the drawing, which show exemplary details of embodiments of the invention. The individual features can be implemented individually or combined in any combination in variants of the invention.

In the schematic drawing, exemplary embodiments of the present invention are shown which are explained in more detail in the following description.

Figure 4A:
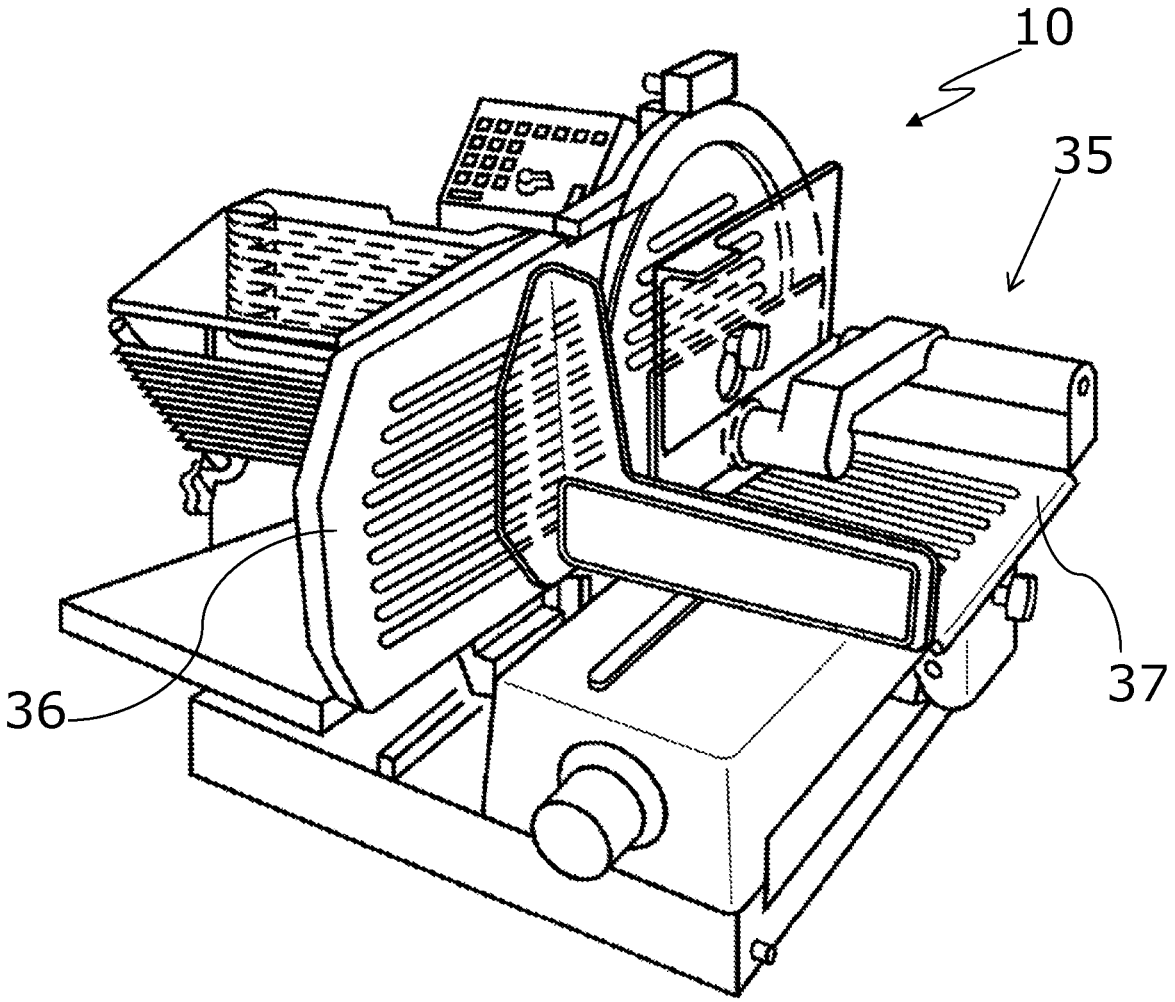
FIG. 4*a* an isometric view of the slicing machine according to the invention embodied as a vertical cutter.

FIG. 1 shows a longitudinal section through a motor tower 9 of a slicing machine 10 according to and embodiment of the present invention (see FIG. 4*a*). The slicing machine 10 has a machine housing 11 for protection. In the machine housing 11, there is a drive motor 13 for driving a rotating and/or circumferentially movable circular blade 14 for severing the cutting material. The circular blade 14 is mounted directly on a bearing shaft 15 arranged in the drive motor 13 for the circular blade 14. The drive motor 13 comprises a stator 16 and a rotor 17 detachable from the stator 16. The stator 16 is arranged in the machine housing 11. The machine housing 11 has an insertion opening 18. In the assembled state, the stator 16 is arranged at the insertion opening 18. The rotor 17 is inserted in the stator 16 through the insertion opening 18. A protective cap 19 is arranged on the rotor 17 in the circumferential direction and in a manner abutting the machine housing 11 and the circular blade 14.

Figure 2A:
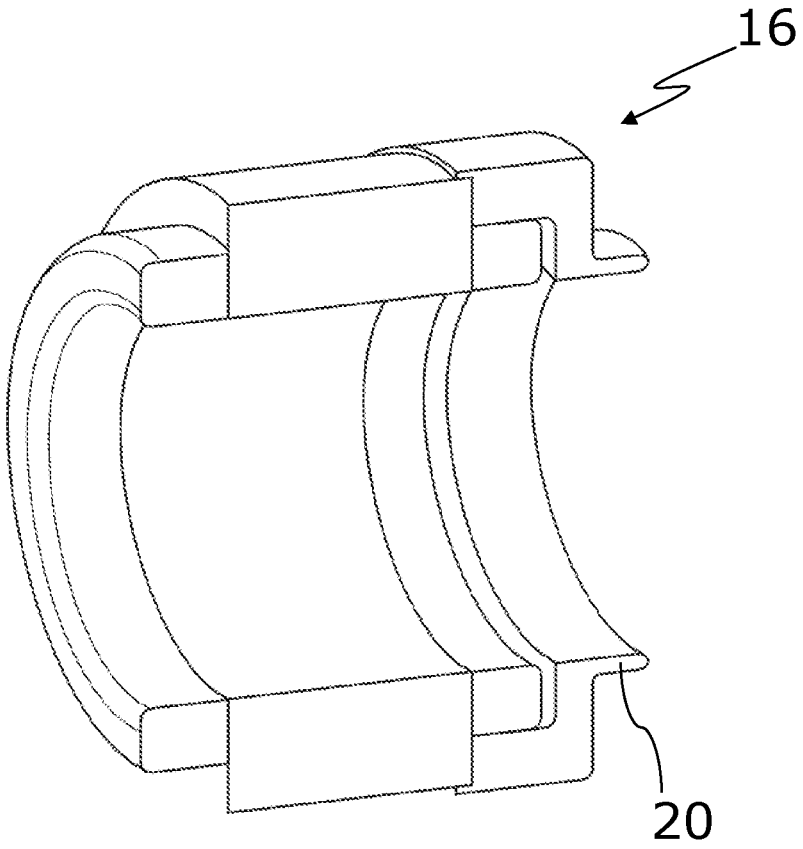
FIG. 2*a* a longitudinal section through a stator without the rotor that can be detached from the stator.

FIG. 2*a* shows a longitudinal section through the stator 16 without the rotor 17, which is detachable from the stator (see FIG. 1). The stator 16 has an insertion ring 20 for the introduction of the stator 16 into the insertion opening 18 (see FIG. 1) of the machine housing 11.

Figure 2B:
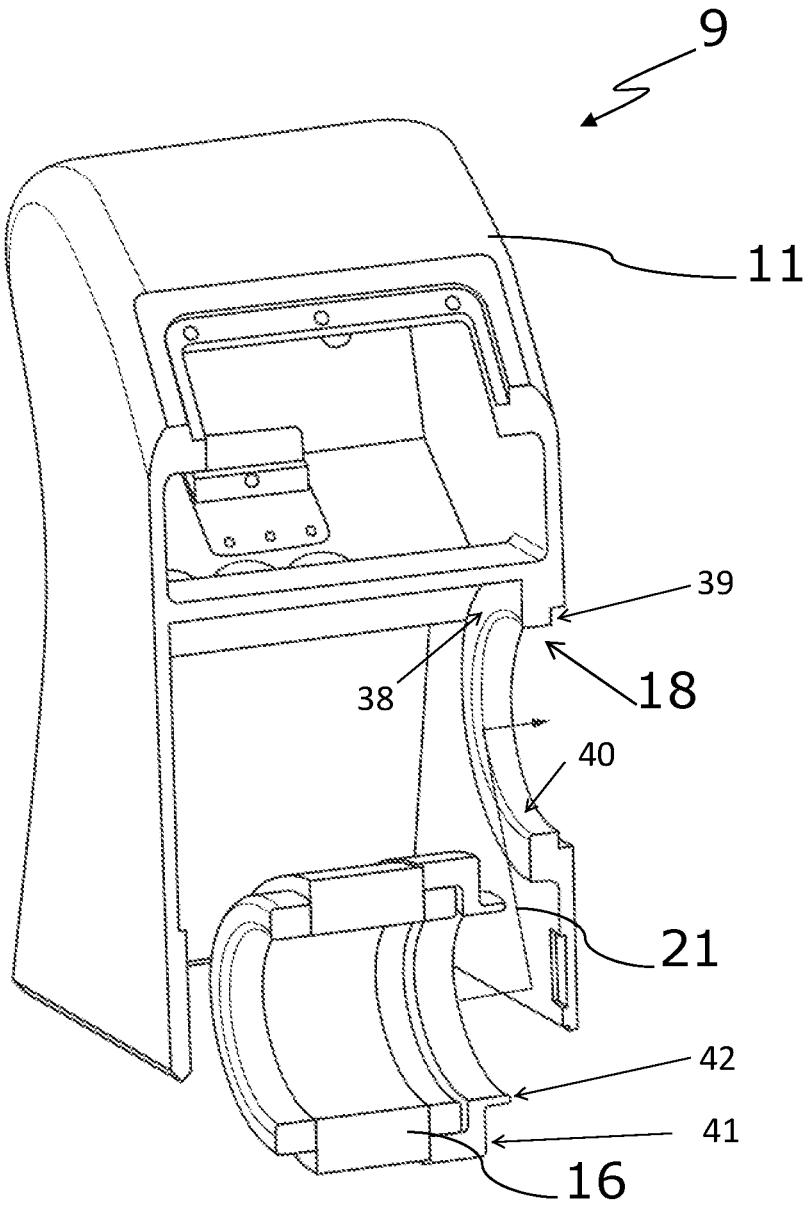
FIG. 2*b* a longitudinal section through the stator and the motor tower.

FIG. 2*b* shows a longitudinal section through the motor tower 9 with the stator 16 and the machine housing 11. An arrow 21 indicates the direction of insertion of the stator 16 for insertion into the insertion opening 18 of the machine housing 11.

Figure 2C:
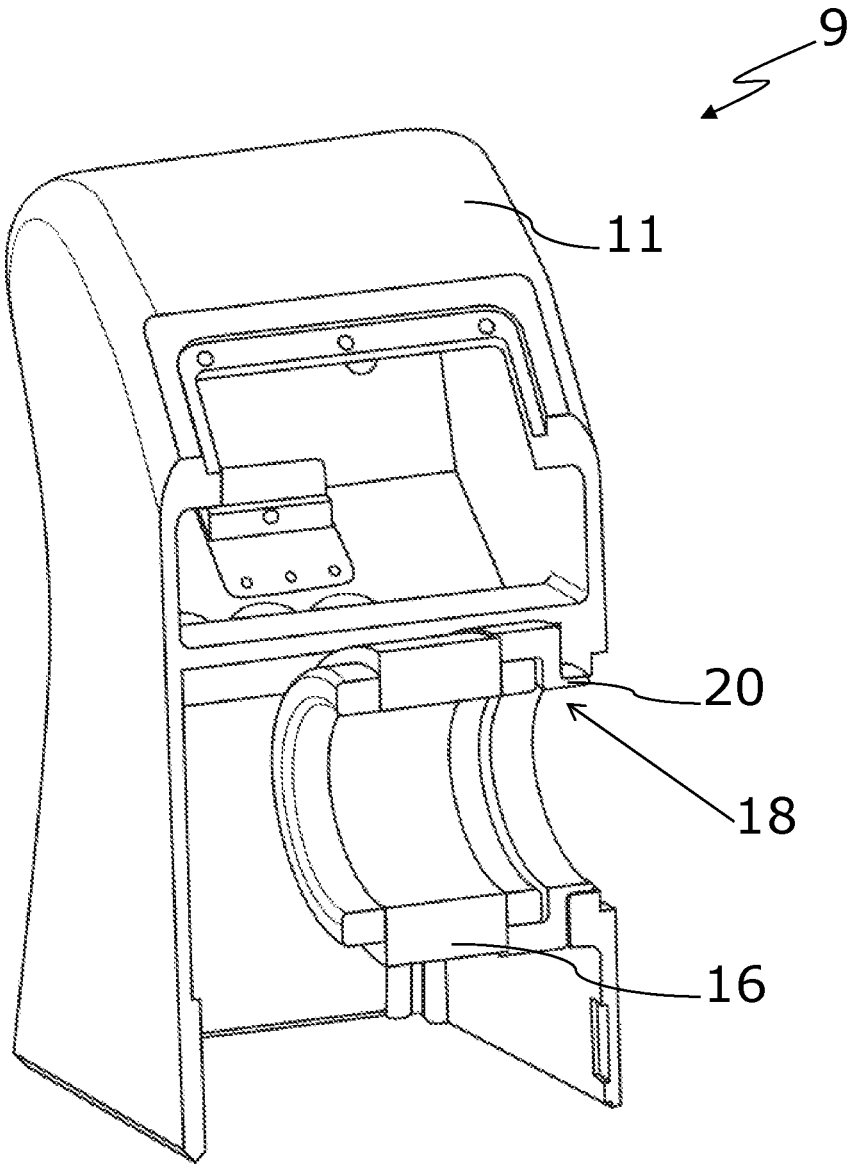
FIG. 2*c* a longitudinal section through the stator and the motor tower, wherein the stator occupies its final position in the motor tower.

FIG. 2*c* shows a longitudinal section through the motor tower 9 with the stator 16 and the machine housing 11, wherein the stator 16 occupies its final position in the machine housing 11. The stator is arranged in abutment with its insertion ring 20 in the insertion opening 18 of the machine housing 11.

Figure 3A:
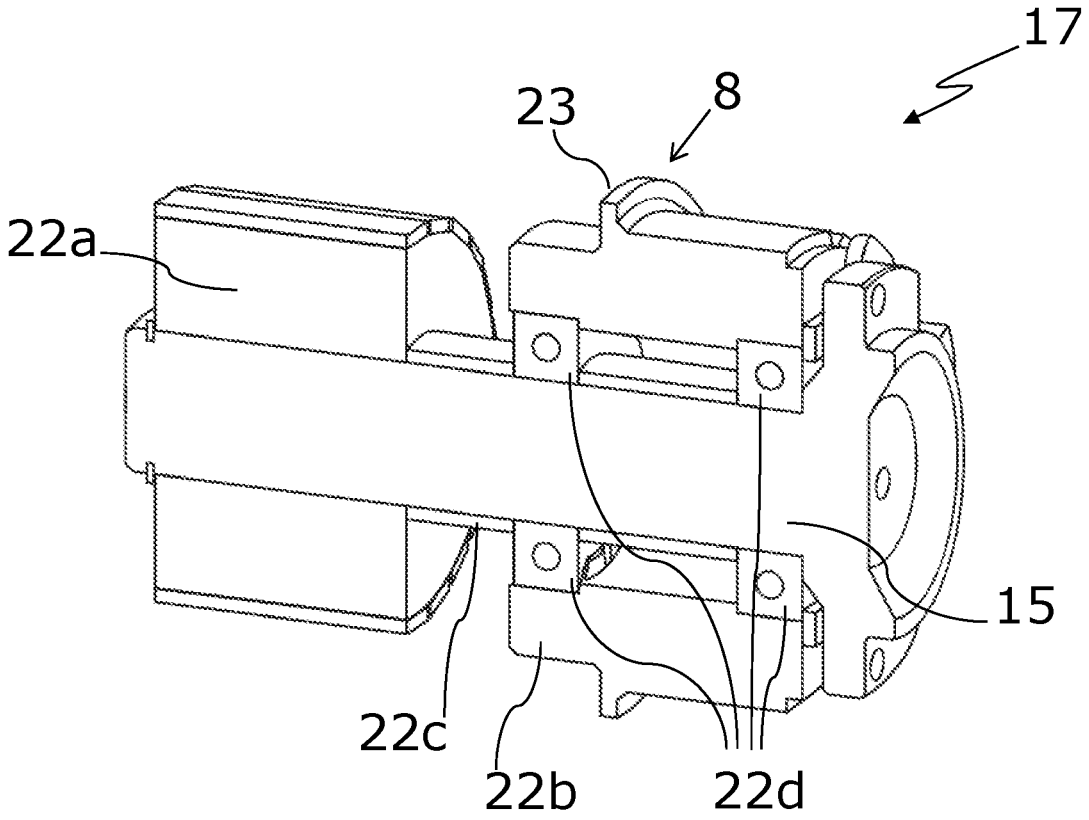
FIG. 3*a* a longitudinal section through the rotor detached from the stator.

FIG. 3*a* shows a longitudinal section through the rotor 17 detached from the stator 16 (see FIG. 1) with the bearing shaft 15. An abutment section 22*a* rests firmly against the bearing shaft 15 in the assembled state of the rotor 17. In the installed state, a holding section 22*b* abuts the insertion ring 20 and is separated by ball bearings 22*d* from the bearing shaft 15, which is rotatable relative to the machine housing 11. Furthermore, a spacer 22*c* is provided between the abutment section 22*a* and the ball bearings 22*d* adjacent thereto.

The spacer 22*c* has a narrower diameter than the abutment section 22*a* and the holding section 22*b* in order to save weight.

A fastening part 8 of the rotor 17 with which the rotor 17 can be fastened to the machine housing 11 comprises a projection 23 which in the assembled state abuts the machine housing 11.

Figure 3B:
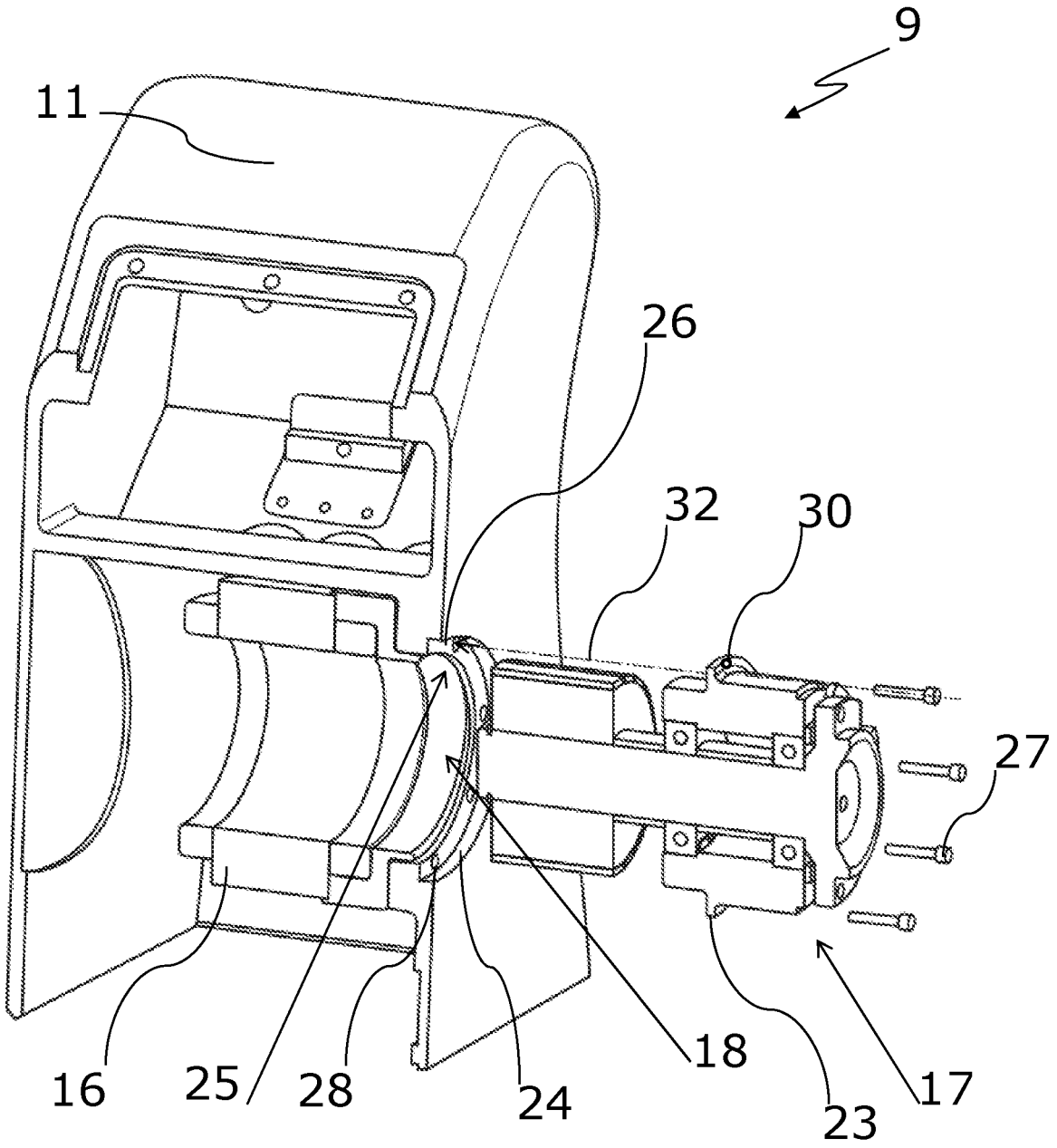
FIG. 3*b* a longitudinal section through the motor tower, the rotor and the stator before installation of the rotor.

FIG. 3*b* shows a longitudinal section through the motor tower 9 with the machine housing 11, the rotor 17 and the stator 16. The stator 16 is arranged at the insertion opening 18. The rotor 17 is inserted into the stator 16. The insertion opening 18 is formed with a stepped recess 24 for positioning the rotor 17. The motor tower 9 has an attachment device 25, in particular in the form of a holder 26, for fastening the rotor 17 and stator 16 to the machine housing 11 by means of fastening means 27, in particular screws or bolts.

The attachment device 25 comprises first through-openings 28 for introducing the fastening means 27, which are arranged around the insertion opening 18 of the machine housing 11. Second through-openings 30 are formed in the projection 23 of the rotor 17. The stator 16 has fastening-means receptacles in the circumferential direction for receiving and fastening the fastening means 27. Arrows 32 indicate the direction of insertion of the fastening means 27 through the first and second through-openings 29, 30 into the fastening-means receptacles of the stator 16.

Figure 3C:
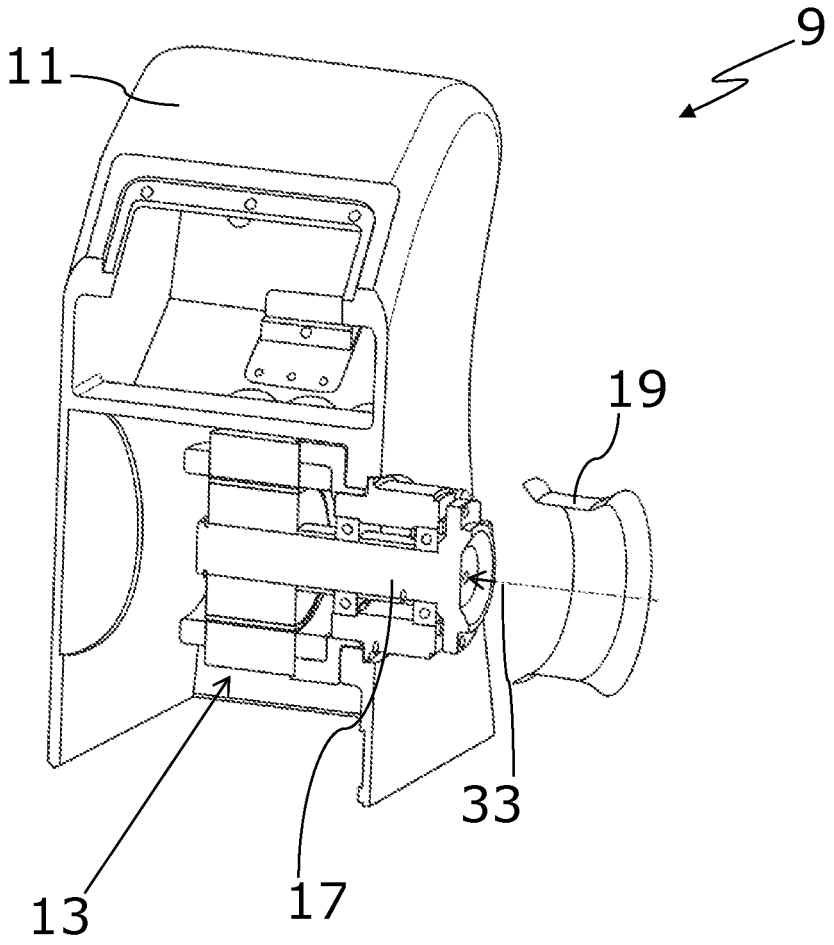
FIG. 3*c* a longitudinal section through the drive motor in the motor tower with a protective cap.

FIG. 3*c* shows a longitudinal section through the motor tower 9 with the drive motor 13 in the machine housing 11 and through the protective cap 19 for the rotor 17. The protective cap 19 is fastened on the rotor 17 from the outside in the direction of the arrow 33.

Figure 3D:
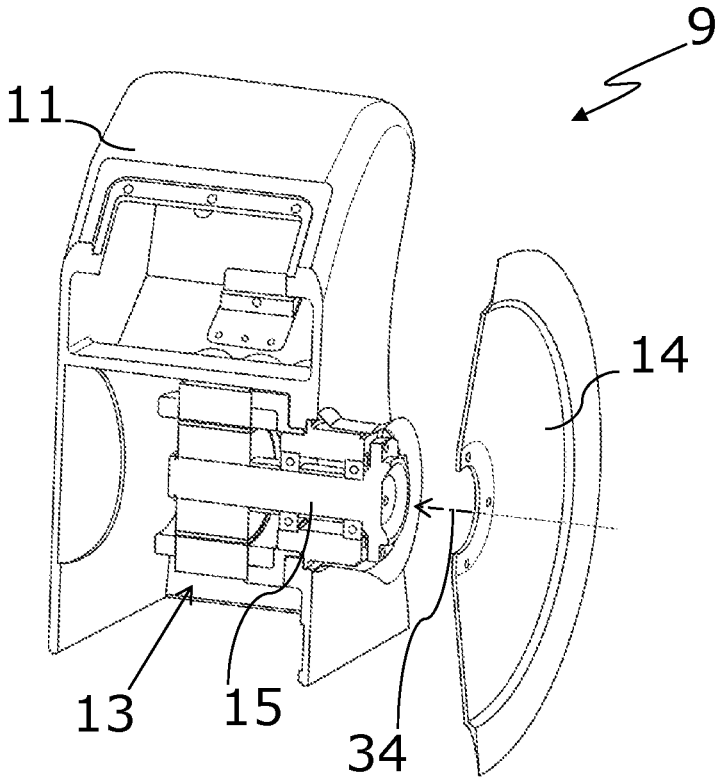
FIG. 3*d* a longitudinal section through the motor tower with the drive motor and through the circular blade.

FIG. 3*d* shows a longitudinal section through the motor tower 9 with the drive motor 13 in the machine housing 11 and the circular blade 14 mounted on the bearing shaft 15 of the drive motor 13. The mounting direction 34 of the bearing shaft 15 is indicated by an arrow.

Figure 4B:
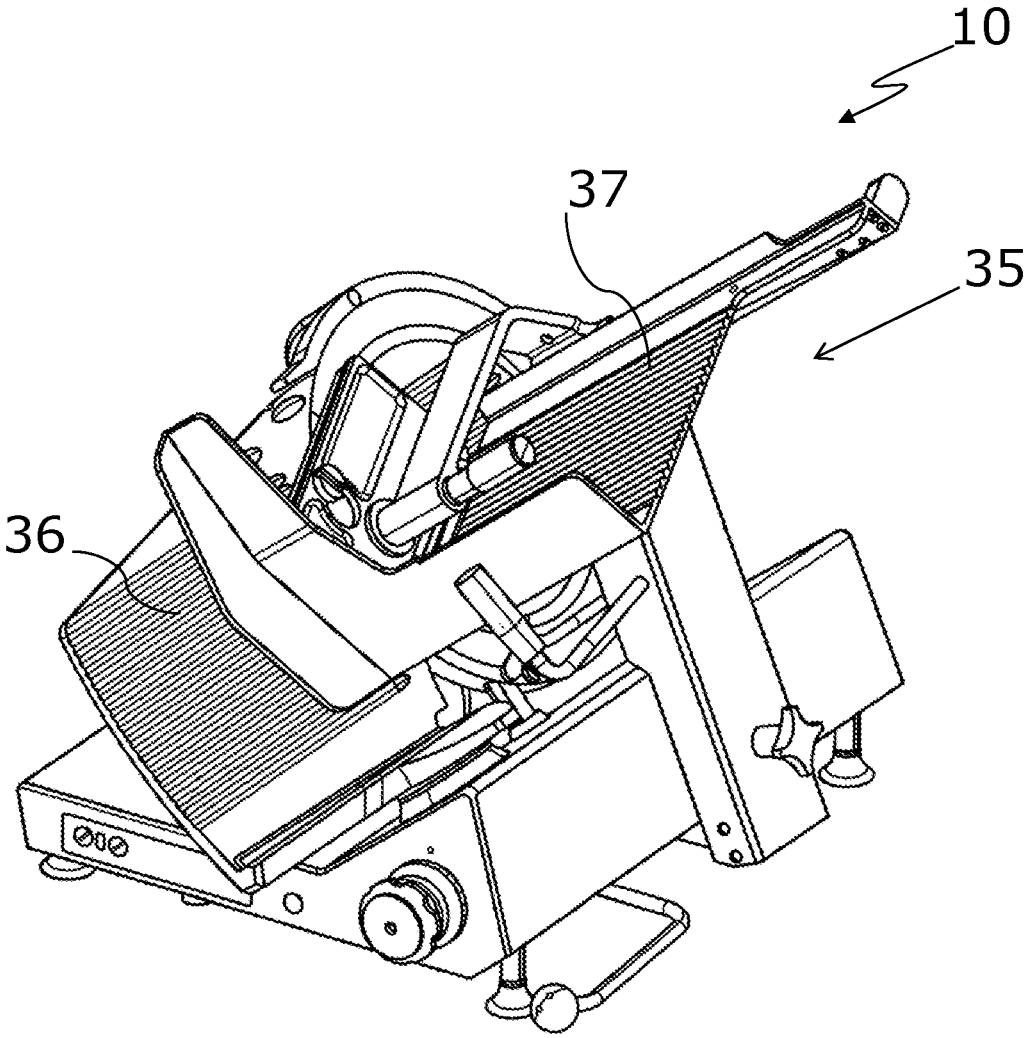
FIG. 4*b* an isometric view of the slicing machine according to the invention embodied as an inclined cutter.

FIGS. 4*a* and 4*b* show a first and a second isometric view of the slicing machine 10 according to an embodiment of the present invention. A product feeder 35 of the slicing machine 10 feeds the cutting material to the circular blade 14 (see FIG. 1). The slicing machine 10 comprises a stop plate 36 along with a slidably arranged carriage 37 via which the cutting material is fed to the circular blade 14.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

LIST OF REFERENCE NUMBERS

8 Fastening part (fastening body)
9 Motor tower
10 Slicing machine
11 Machine housing
13 Drive motor
14 Circular blade
15 Bearing shaft
16 Stator
17 Rotor
18 Insertion opening
19 Protective cap
20 Insertion ring
21 Insertion direction
22*a* Abutment section
22*b* Holding section

22*c* Spacer
22*d* Ball bearings
23 Projection
24 Stepped recess
25 Attachment device
26 Holder
27 Fastening means
28 First through-openings
30 Second through-openings
32 Direction of insertion of the fastening means
33 Mounting direction of the protective cap
34 Mounting direction
35 Product feed
36 Stop plate
37 Carriage
38 interior face
39 exterior face
40 lip portion
41 circumferential face
42 circumferential protrusion

The invention claimed is:

1. A slicing machine for cutting slices of extrudate-shaped cutting material, the slicing machine comprising:

a machine housing, which holds a drive motor and a rotating or circumferentially movable circular blade, which is driven by the drive motor;

a product feed, which is configured to feed the cutting material to the circular blade;

a stop plate; and a slidably arranged carriage, which is configured to feed the cutting material to the circular blade, wherein the circular blade is mounted directly on a bearing shaft arranged in the drive motor for the circular blade, wherein the drive motor comprises at least one stator and one rotor, wherein the stator is arranged in the machine housing, wherein the machine housing has an insertion opening where, in the assembled state, the stator is arranged and through which the rotor is at least partially inserted into the stator, wherein the slicing machine has an attachment device comprising a first fastener, the first fastener, in the assembled state, fastening both the rotor to an exterior portion of the machine housing and the stator to an interior portion of the machine housing via a first through opening in the machine housing, wherein the rotor is configured to be detachable from the stator and the machine housing from outside the machine housing, wherein the machine housing is configured as a motor tower consisting of a single integral piece, and wherein the stator, in its assembled state, is sized such that it is incapable of passing through the insertion opening from the interior portion of the motor tower.

2. The slicing machine according to claim 1, wherein the first through opening is arranged at a periphery of the insertion opening of the machine housing.

3. The slicing machine according to claim 2, wherein the stator has a fastener receptacle in a circumferential direction for receiving the first fastener.

4. The slicing machine according to claim 3, wherein the stator and the rotor are configured to interface with the machine housing such that the fastener receptacle of the stator and second through-opening of the rotor are aligned with the first through-opening of the attachment device in order to introduce the first fastener.

5. The slicing machine according to claim 1, wherein the rotor has a second through-opening in a circumferential direction for introducing the first fastener.

6. The slicing machine according to claim 1, wherein at least part of the bearing shaft is arranged in the rotor outside the machine housing.

7. The slicing machine according to claim 1, wherein the attachment device at a periphery of the insertion opening of the machine housing has a stepped recess or a chamfer for a centering insertion of the rotor.

8. The slicing machine according to claim 1, wherein the attachment device comprises a lip for holding the stator or the rotor that is arranged on an inner wall of the machine housing.

9. The slicing machine according to claim 1, wherein a protective cap is arranged on the rotor in a circumferential direction and in a manner abutting the machine housing and the circular blade.

10. The slicing machine according to claim 1, wherein the rotor has a fastening body which is, using the attachment device, is fastenable to the machine housing or to the stator, in the fastening body, the bearing shaft with the circular blade is mounted rotatably.

11. The slicing machine according to claim 10, wherein the bearing shaft is fluid-sealed relative to the interior of the machine housing.

12. The slicing machine according to claim 1, wherein the rotor has an abutment section which at one end is firmly seated on the bearing shaft and is connected by a spacer to ball bearings, which separate a holding section connected to the stator from the rotatable bearing shaft, wherein the spacer has a narrower diameter than the abutment section and the holding section.

13. The slicing machine according to claim 1, wherein the stator has an insertion ring for insertion into the insertion opening of the machine housing.

14. The slicing machine according to claim 1, wherein the insertion opening of the machine housing has a circular or square cross-section.

15. The slicing machine according to claim 1, wherein a portion of the attachment device is integrated into to the machine housing, the portion of the attachment device that is integrated into the machine housing has an interior face and an exterior face, and a lip portion extending from the interior face to the exterior face, the lip portion defining the insertion opening, wherein the stator comprises a circumferential face and a circumferential protrusion extending longitudinally from the circumferential face, wherein, in the assembled state, the circumferential face of the stator abuts the interior face of the attachment device, wherein, in the assembled state, the circumferential protrusion extends into insertion opening and abuts the lip portion of the attachment device, wherein the rotor comprises a protrusion extending in a radial direction, the protrusion having a bearing face, wherein, in the assembled state, bearing face of the protrusion abuts the exterior face of the attachment device, and wherein the first fastener extends through the protrusion of the rotor, the exterior face of the attachment device, the interior face of the attachment device, and the circumferential face of the stator, with the exterior face and the interior face of the attachment device being interposed between the circumferential face of the stator and the protrusion of the rotor.

16. A method of manufacturing a slicing machine, the method comprising:

providing: a two-part drive motor, with a stator and a rotor, a machine housing, with a insertion opening, and an attachment device;

pre-assembling the stator inside the machine housing at the insertion opening;

introducing the rotor, from outside the machine housing through the insertion opening, into the stator;

using a first fastener, fastening both the rotor to an exterior portion of the machine housing and the stator to an interior portion of the machine housing via a first through opening in the machine housing, the rotor being fastened such that it is capable of being detached from the machine housing and the rotor from outside the machine housing; and fastening a circular blade to the rotor outside of the machine housing, wherein the machine housing is configured as a motor tower consisting of a single integral piece, and wherein the pre-assembling the stator inside the machine housing comprises inserting components of the stator in the interior portion of the motor tower and assembling the stator, the assembled stator being sized such that it is incapable of passing through the insertion opening.

* * * * *